US005513903A

United States Patent [19]

Mraz

[11] Patent Number: 5,513,903

[45] Date of Patent: May 7, 1996

[54] METHOD AND APPARATUS FOR DEVELOPING SHAFTS USING SMALL DIAMETER SHAFTS

[75] Inventor: Dennis Mraz, Saskatoon, Canada

[73] Assignee: Deep Shaft Technology, Inc., Alberta, Canada

[21] Appl. No.: 300,215

[22] Filed: Sep. 6, 1994

[51] Int. Cl.[6] ..... E21D 7/02

[52] U.S. Cl. ..... 299/18; 187/405

[58] Field of Search ..... 299/18; 405/133; 187/266, 257, 405

[56] References Cited

U.S. PATENT DOCUMENTS

| | | | |
|---|---|---|---|
| 289,231 | 11/1883 | Coleman | 187/266 |
| 656,899 | 6/1901 | Kottgen et al. | 254/378 |
| 763,989 | 7/1904 | Laughlin, Jr. | 187/257 |
| 780,290 | 1/1905 | Hopkinson | 226/193 |
| 1,053,425 | 2/1913 | Metzler | 182/141 |
| 1,082,398 | 12/1913 | Blowers | 187/266 X |
| 3,378,304 | 4/1968 | Borasio et al. | 299/18 |
| 3,880,258 | 4/1975 | Rompa | 187/239 |
| 3,992,060 | 11/1976 | Bargel et al. | 299/67 |
| 3,993,355 | 11/1976 | Cunningham | 299/31 |
| 4,601,607 | 7/1986 | Lehmann | 405/133 |
| 4,674,602 | 6/1987 | Smith et al. | 414/251 |
| 5,049,022 | 9/1991 | Wilson | 414/253 |
| 5,107,963 | 4/1992 | Rocca et al. | 187/410 |
| 5,152,583 | 10/1992 | Grathoff et al. | 299/39 |

FOREIGN PATENT DOCUMENTS

| | | | |
|---|---|---|---|
| 235694 | 3/1964 | Netherlands | 187/257 |
| 1059193 | 12/1983 | U.S.S.R. | 405/133 |

*Primary Examiner*—David J. Bagnell
*Attorney, Agent, or Firm*—Morgan & Finnegan

[57] ABSTRACT

A mining method and apparatus includes drilling two relatively small diameter shafts in proximity to each other, and operating a single hoisting system between the two shafts. The hoisting system includes a hoist that simultaneously moves first and second conveyances in opposite directions respectively in the first and second shafts.

22 Claims, 3 Drawing Sheets

METHOD AND APPARATUS FOR DEVELOPING SHAFTS USING SMALL DIAMETER SHAFTS

FIELD OF THE INVENTION

The present invention relates generally to underground mining techniques and, more specifically, to using small diameter shafts drilled by shaft drilling techniques for mine development, instead of single large diameter shafts.

BACKGROUND OF THE INVENTION

Most of the underground mines in the world are developed through sinking of vertical shafts, because many naturally occurring mineral deposits are buried deep beneath the earth surface. Until recently, the most commonly used shaft development technique had been the method of conventional shaft sinking, which utilizes workers at the face of the shaft for manual drilling and blasting of rock, rock removal to the surface and installation of supporting shaft liner. The conveyance guiding and other facilities required in the shafts are also installed manually.

More recently, the method of full face shaft drilling had come to the fore, which is substantially more economical and safer than the conventional sinking. Unfortunately, for deeper deposits the diameter of drilled shafts is limited by difficulties in installing shaft liner or casing, and by other problems associated with drilling to the greater depths.

Most shafts must accommodate various mine services. These usually include at least two conveyances for hoisting of rock or mineral, with their guidance systems, electric cables, pipes for water supply or pumping, as well as other services. For that reason, the required diameters of shafts are quite large, which makes the shaft drilling method impractical for deeper mineral deposits.

An example of a mine shaft hoist and guide system is described in U.S. Pat. No. 4,601,607 to Lehmann, wherein a headframe supports a plurality of sheaves. The sheaves and associated cable and hoist move conveyances in and out of the shaft.

It would be therefore desirable to accommodate all the required services in the same or a greater number of smaller shafts. This would be easily possible, except for the hoisting facilities, because the typical hoisting system includes a single hoist with two conveyances, which have to be accommodated in a single shaft.

SUMMARY OF THE INVENTION

An object of the present invention is therefore to accommodate two or more conveyances of a single hoisting system in two or more smaller shafts located in a close proximity of one another.

Another object of the present invention is to provide a mining technique which employs means of guiding conveyances within casings of drilled shafts, whereby their installation is more space efficient, more stable and accurate for conveyance guiding and, overall, more economical to construct and operate.

These and other objects of the invention are met by providing a method of developing a mine which includes the steps of forming a first shaft, forming a second shaft in proximity to the first shaft, and operating a single hoisting system in the first and second shafts.

In another aspect of the invention includes a hoisting system for simultaneously moving first and second conveyances respectively in first and second shafts disposed in proximity to each other, wherein the hoisting system includes a hoist, a headframe disposed over the first and second shafts, and including first and second head sheaves, and means for connecting the first and second conveyances to each other and operatively engaging the hoist, the hoist being operable to move the first and second conveyances simultaneously in opposite directions.

DETAILED DESCRIPTION OF THE PREFERRED EMBODIMENTS

In a departure from the prior art mining techniques, the present invention includes a method in which two shafts of relatively small diameter are drilled in relative proximity to each other. The two shafts are of a diameter within the capabilities of equipment used for drilling gas wells, for example, equipment that employs standard drilling equipment for gas and oil wells. To provide a comparison, a prior art single shaft for mine development may have an outer diameter of about twenty-three feet, whereas each shaft of the present invention could have an outer diameter of about eleven feet.

Figure 1:
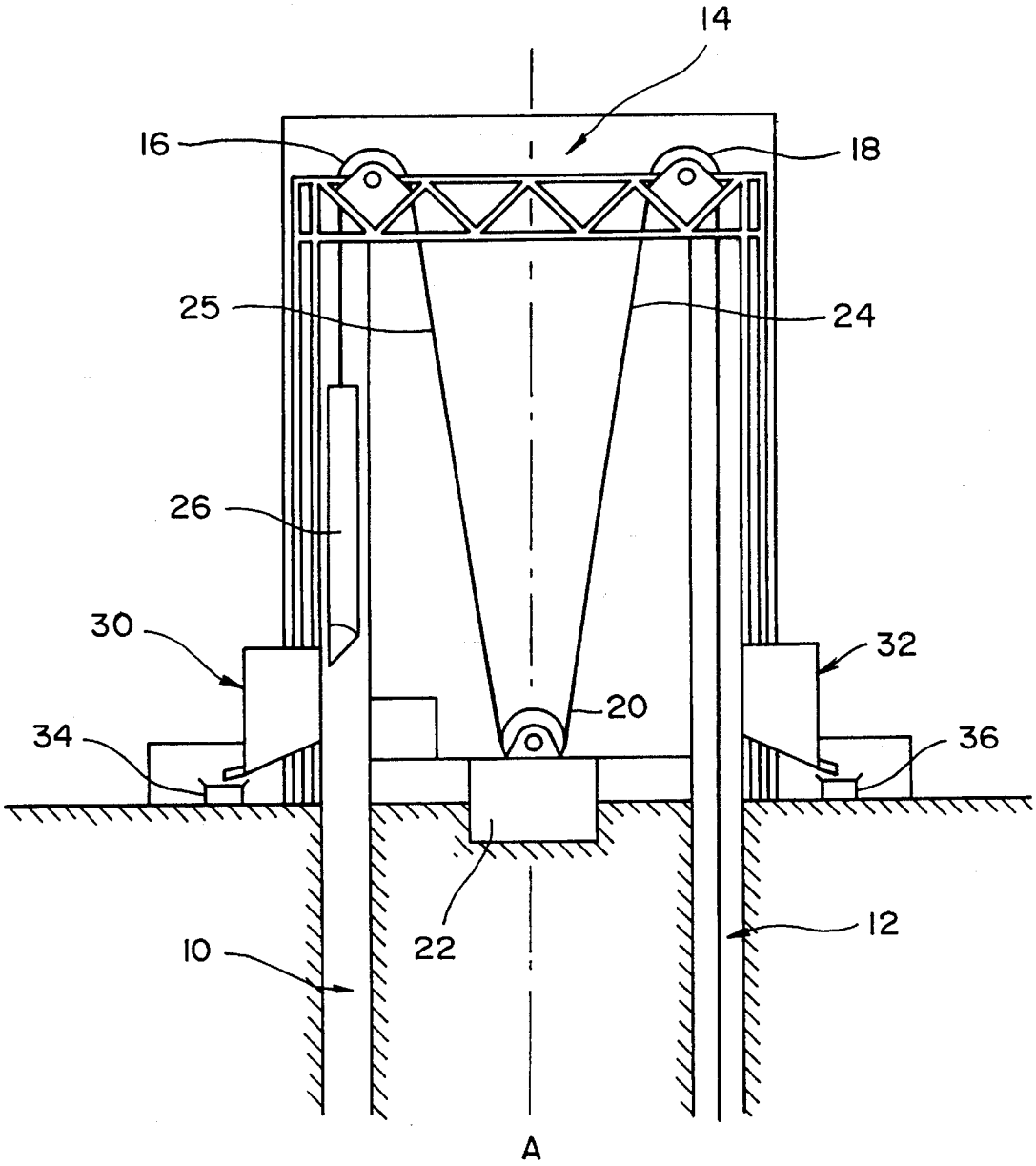
FIG. 1 is a schematic side elevational view of a first, preferred embodiment of the present invention.

Referring to FIG. 1, the two shafts 10 and 12 are located in close proximity of one another, typically about fifty feet. A headframe 14 disposed over the two shafts 10 and 12 supports first and second head sheaves 16 and 18. A drum-type hoist 20 is located between the shafts 10 and 12 on a foundation 22. While the hoist 20 is shown on the center line "A" between the two shafts 10 and 12, and located on the ground, it may be located on the headframe 14 or on the side, or in other standard locations.

Ropes 24 and 25 are reeved over the upper sheaves and the drum hoist 20 to support conveyances 26 in both shafts 10 and 12 (although only the one in shaft 10 is shown). As is conventional with drum-type hoists, first ends of the ropes 24 and 25 are fixedly coupled to the drum hoist 20, while opposite second ends are fixedly coupled to the conveyances. Winding of one rope by the drum will simultaneously unwind the other rope. The two ropes are of identical length.

An enclosure 28 can optionally be disposed over the headframe 14. Skips of the conveyances 26 discharge into bins 30 and 32, which in turn discharge into a means of surface transportation, such as conveyors 34 and 36, respectively.

When the conveyance 26 in the shaft 10 is in its uppermost position for unloading (as shown in FIG. 1), the conveyance in shaft 12 is in its lowermost position for loading.

Figure 2:
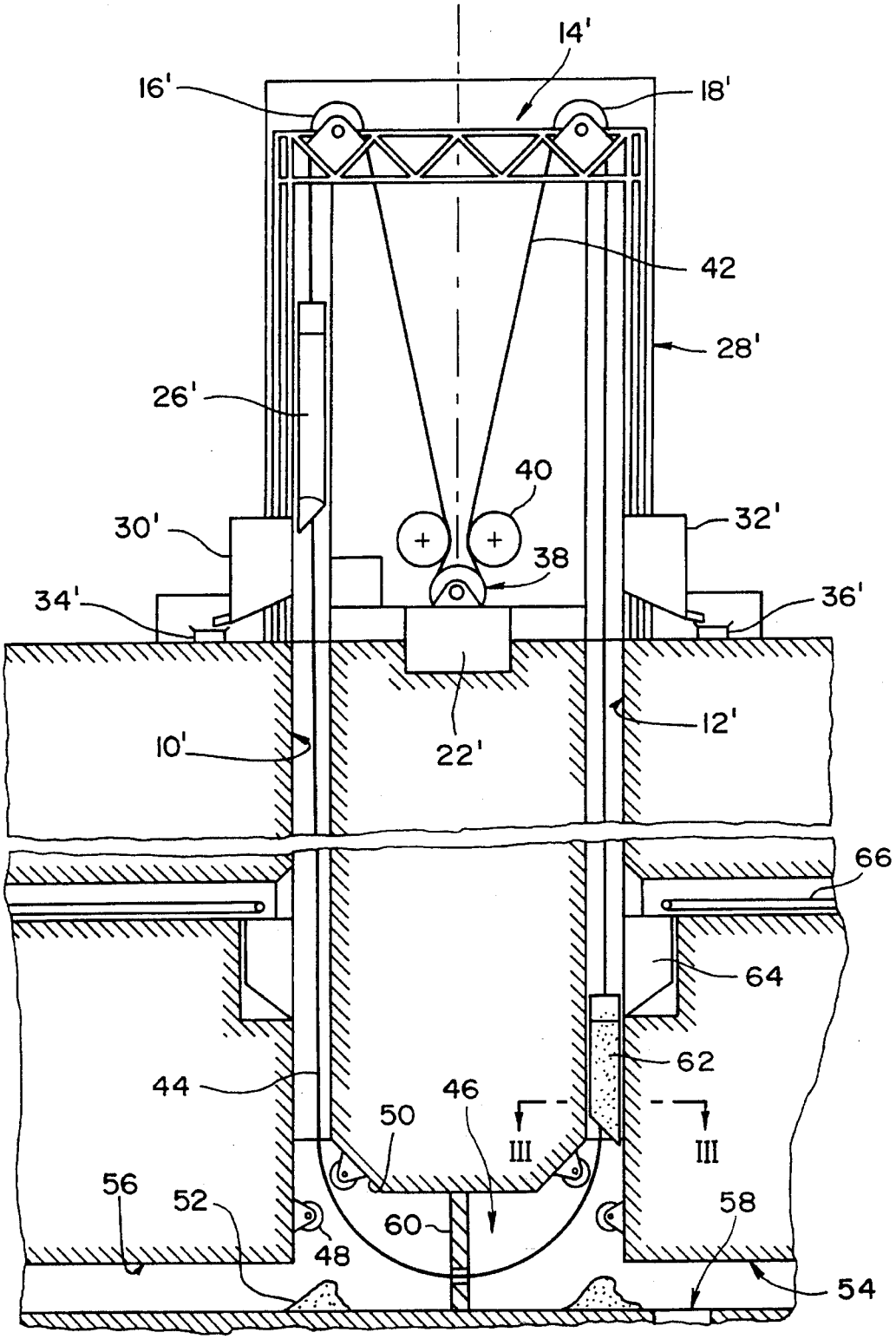
FIG. 2 is a schematic side elevational view of a second, preferred embodiment of the present invention.

FIG. 2 illustrates a variation of the embodiment of FIG. 1, in which the same, but primed, reference numerals are used for substantially the same components. Rather than a drum-type hoist, however, the embodiment of FIG. 2 employs a friction-type hoist 38.

The hoist 38 includes a pair of deflection sheaves 40, a headrope 42 and a balance rope 44. With this type of hoist, the headrope 42 is not fixedly attached, but is instead frictionally engaged with, the hoist 38. The deflection sheaves 40 increase the angle of wrap of the headrope 42 on the hoist 38, thereby increasing the frictional engagement.

At their lower ends, the shafts 10' and 12' are connected through a tunnel 46 which accommodates the balance rope 44. Rub drums 48 may be installed at appropriate locations to prevent damage of the balance rope 44 by rubbing on rock 50. Spill 52 from the conveyances can be removed through access tunnels 54 and 56, while water can be collected and removed by pumping via sump 58.

Ventilation barrier 60 can be located in the tunnel 46 with a rope passage therethrough, thereby isolating the two shafts in case one or both are used as part of the ventilation system. If the barrier 60 is not necessary, then only one of the two access tunnels 54 and 56 would be necessary for removal of spill from the two shafts.

When the conveyance 26' is in the unloading position, conveyance 62 in shaft 12' is in a loading position, as shown in FIG. 2. In particular, the conveyance 62 is positioned below a loading bin 64 located at the end of a loadout conveyor 66. A substantially identical arrangement is located in the shaft 10' so that the conveyance 26' can be loaded while conveyance 62 is being unloaded.

Figure 3:
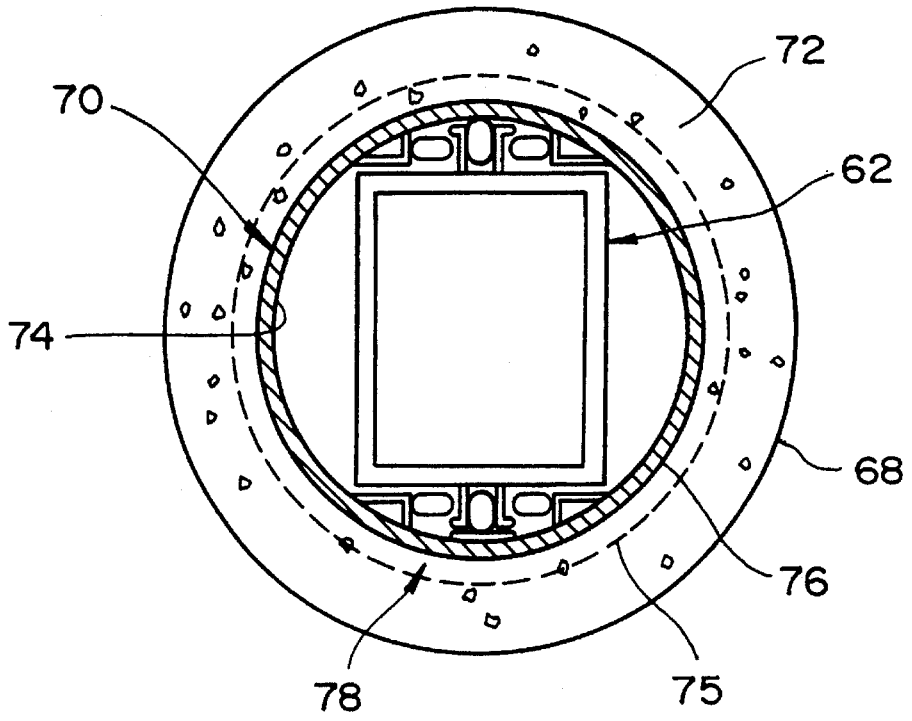
FIG. 3 is a transverse cross-sectional view taken along line III—III of FIG. 2.

Referring to FIG. 3, a transverse cross-section of a drilled shaft 12' is shown with the conveyance 62 disposed therein. The shaft is at first formed by drilling the shaft to achieve a diameter of, for example, eleven feet. The diameter of the bore hole is represented by the circle 68.

When the desired depth is reached, the drilling equipment is withdrawn, and a cylindrical casing 70 is placed in the bore. The annular space between the bore and the casing 70 is filled with cementitious material 72. The casing is formed by joining segments of steel tubing, end-to-end, typically by welding.

The casing 70 has a smooth, continuous cylindrical inner surface 74 having a diameter of about eight feet, for example. Each segment is typically in ten foot lengths and is typically welded end-to-end as the tubing is lowered into the bore. Alternatively, the sections could be bolted together. Also, the individual segments could be made of other materials including cast iron or reinforced concrete.

A particularly preferred casing, made of ten foot steel segments, has a one inch thick cylindrical sidewall. The inner surface 74 is smooth, and the outer surface 76 is structurally reinforced by additional steel members 75 which provide additional strength.

Preferably, a guidance system 78 is preassembled in each segment of tubing so that as the segments are assembled end-to-end, the guidance system is substantially formed as the casing is formed. The guidance system 78 is of a type having two complementary portions, one disposed on the casing and the other on the conveyance 62.

Figure 4:
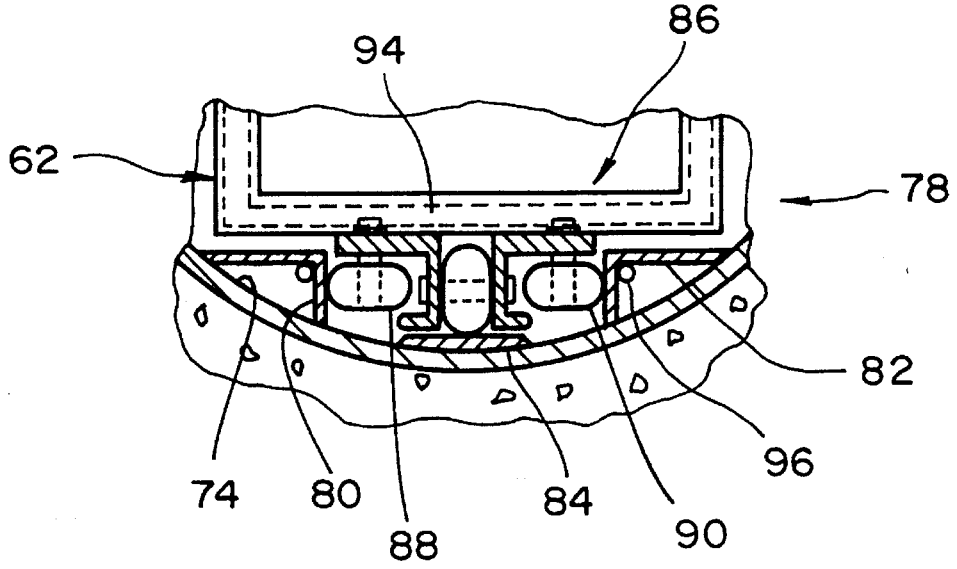
FIG. 4 is an enlarged view of a portion of the guide means used in the embodiment of FIG. 2.

As seen in FIG. 4, the guidance system 78 includes two portions mounted on diametrically opposite sides of the inner surface 74. Each portion includes a guide means and follower means. The guide means includes two shoulder members 80 and 82, and a planar member 84. These members collectively define a substantially U-shaped guide.

At locations corresponding to the disposition of the U-shaped guides, the conveyance 62 is provided with a follower roller assembly 86, each of which includes two side rollers 88, 90 which engage the side surfaces of the two shoulder members 80 and 82. The assembly 86 further includes a front roller 94 which engages the planar member 84.

The guide means illustrated in FIGS. 3 and 4 can be varied such that the guide means could be a protruding rail, as opposed to the illustrated recessed rail, whereupon the rollers could be adapted to conform to the outer rail surfaces. Moreover, the number and locations of rollers can be varied to achieve the same or similar results. Locator pins 96, installed within guidance system, provide perfect connection between sections of casing for the purpose of casing assembly, as well as flawless continuation of guiding system.

While the present invention has been described and illustrated using two shafts, more than two shafts and a single hoist system could be envisioned.

Numerous modifications and adaptations of the present invention will be apparent to those skilled in the art and it is intended by the following claims to cover all such modifications and adaptations which fall within the true spirit and scope of this invention.

What is claimed is:

1. A method of developing a mine comprising the steps of:

forming a first shaft;

forming a second shaft in proximity to, but not in communication with, the first shaft; and operating a single hoisting system in the first and second shafts.

2. A method according to claim 1, wherein the steps of forming the first and second shafts comprises drilling first and second bore holes having substantially the same diameters.

3. A method according to claim 2, wherein the diameter of the first and second bore holes is less than about twelve feet.

4. A method according to claim 2, further comprising placing first and second cylindrical casings respectively in the first and second bore holes, thereby forming first and second annular spaces between each bore hole and corresponding casing, and filling the first and second annular spaces with a cementitious material.

5. A method according to claim 1, wherein the step of operating a single hoisting system comprises placing a first conveyance in the first shaft, connecting a first rope to the first conveyance and to a drum hoist, placing a second conveyance in the second shaft, connecting a second rope to the second conveyance and to the drum hoist, and operating the drum hoist to simultaneously move the first and second conveyances in opposite directions.

6. A method according to claim 5, further comprising placing the drum hoist between the first and second shafts, and reeving the first and second ropes over first and second head sheaves disposed over the first and second shafts, respectively.

7. A method according to claim 1, wherein the step of operating a single hoisting system comprises placing a first conveyance in the first shaft, placing a second conveyance in the second shaft, connecting a headrope to the first and second conveyances, reeving the headrope over a friction hoist, and operating the friction hoist to simultaneously move the first and second conveyances in opposite directions.

8. A method according to claim 7, further comprising forming a connecting tunnel between the first and second shafts and connecting a balance rope to the first and second conveyances through the connecting tunnel.

9. A method according to claim 7, further comprising placing the friction hoist between the first and second shafts, and reeving the headrope over first and second head sheaves disposed over the first and second shafts, respectively.

10. An apparatus for developing a mine comprising:

means for forming a first shaft;

means for forming a second shaft in proximity to, but not in communication with, the first shaft; and means for operating a single hoisting system in the first and second shafts.

11. An apparatus according to claim 10, wherein the first and second shafts include first and second encasements having substantially the same diameters.

12. An apparatus according to claim 11, wherein the diameter of the first and second encasements is about eight feet.

13. An apparatus according to claim 12, wherein the drum hoist is disposed between the first and second shafts, and the drum hoist further includes first and second head sheaves over which the first and second ropes are reeved.

14. An apparatus according to claim 13, further comprising a balance rope connected between the first and second conveyances through a connecting tunnel.

15. An apparatus according to claim 11, further comprising guidance means disposed in each of the first and second shafts for guiding conveyances up and down the first and second encasements.

16. An apparatus according to claim 15, wherein the means for operating a single hoisting system includes first and second conveyances disposed respectively in the first and second shafts, and the guiding means includes track means formed on each encasement, a guide wheel assembly operatively engaging the track means, and means for positioning segments of each encasement relative to each other during assembly.

17. An apparatus according to claim 10, wherein the means for operating a single hoisting system includes a drum hoist, a first conveyance disposed in the first shaft, a first rope connected to the first conveyance and to the drum hoist, a second conveyance disposed in the second shaft, a second rope connected to the second conveyance and to the drum hoist, the drum hoist being operable to simultaneously move the first and second conveyances in opposite directions.

18. An apparatus according to claim 10, wherein the means for operating a single hoisting system includes a friction hoist, a first conveyance disposed in the first shaft, a second conveyance disposed in the second shaft, a headrope connected to the first and second conveyances and being reeved over the friction hoist, the friction hoist being operable to simultaneously move the first and second conveyances in opposite directions.

19. An apparatus according to claim 18, wherein the friction hoist is disposed between the first and second shafts, the headrope being reeved over first and second head sheaves disposed over the first and second shafts, respectively.

20. A hoisting system for simultaneously moving first and second conveyances respectively in first and second shafts disposed in proximity to each other, but not in communication with each other, the hoist comprising:

a hoist;

a headframe disposed over the first and second shafts, and including first and second head sheaves; and means for connecting the first and second conveyances to each other and operatively engaging the hoist, the hoist being operable to move the first and second conveyances simultaneously in opposite directions.

21. A hoisting system according to claim 20, wherein the connecting means is a headrope connected at its opposite ends to the first and second conveyances and frictionally engaging the hoist at a point intermediate of the opposite ends.

22. A hoisting system according to claim 20, wherein the connecting means comprises a first rope having one end connected to the first conveyance and the opposite end connected to the hoist, a second rope having one end connected to the second conveyance and the opposite end connected to the hoist.

* * * * *